US006142533A

United States Patent [19]

Borowski, Jr.

[11] Patent Number: 6,142,533

[45] Date of Patent: Nov. 7, 2000

[54] LOTTERY TICKET WITH HIDDEN CONDUCTIVE INK SECURITY MEANS

[75] Inventor: Joseph Carl Borowski, Jr., San Antonio, Tex.

[73] Assignee: Oberthor Gaming Technologies, Inc., Montreal, Canada

[21] Appl. No.: 09/298,878

[22] Filed: Apr. 26, 1999

[51] Int. Cl.[7] ..... B42D 15/00

[52] U.S. Cl. ..... 283/111; 283/95; 283/903

[58] Field of Search ..... 280/111, 95, 114, 280/901, 903

[56] References Cited

U.S. PATENT DOCUMENTS

| | | | |
|---|---|---|---|
| 5,601,887 | 2/1997 | Rich et al. | 428/29 |
| 5,667,250 | 9/1997 | Behm et al. | 283/102 |
| 5,681,065 | 10/1997 | Rua, Jr. et al. | 283/903 |
| 5,690,367 | 11/1997 | Fromer | 283/94 |
| 5,803,504 | 9/1998 | Deshiens et al. | 283/67 |
| 5,887,906 | 3/1999 | Sultan | 283/94 |
| 5,925,440 | 7/1999 | Farag et al. | 428/195 |
| 5,984,367 | 11/1999 | Barnhart et al. | 283/92 |

*Primary Examiner*—A. L. Wellington
*Assistant Examiner*—Monica Carter
*Attorney, Agent, or Firm*—Watov & Kipnes, P.C.; Allen R. Kipnes, Esq.

[57] ABSTRACT

The present invention is directed to a scratch-off type lottery ticket in which a layer comprised of a non-conductive ink region and a conductive ink region are printed below an opaque scratch-off layer. The conductive ink region is detectable through the opaque layer by conventional lottery ticket authentication/validation machines.

5 Claims, 1 Drawing Sheet

LOTTERY TICKET WITH HIDDEN CONDUCTIVE INK SECURITY MEANS

FIELD OF THE INVENTION

The present invention is generally directed to lottery tickets and related documents having at least one ink layer lying below an opaque scratch-off layer in which the ink layer has at least a portion thereof comprised of a conductive ink which is detectable by a device which detects the conductivity of the ink to authenticate and/or validate the lottery ticket. The conductive ink portion of the ink layer lies below the opaque scratch-off layer and therefore is invisible from view of the player.

BACKGROUND OF THE INVENTION

The present invention is generally directed to scratch-off lottery tickets employing an opaque scratch-off layer for covering a game area. Scratch-off lottery games have been in use for many years and have gained increasing popularity among lottery players. Security for scratch-off lottery tickets is a continuing problem and there is a continuing need for ways in which to authenticate and/or validate a lottery ticket at the retail establishment when the user seeks to collect a prize. Scratch-off lottery tickets are generally comprised of a non-game data area which can be printed with a wide range of graphics principally directed to making the ticket attractive and/or to present the theme of the lottery game. The non-game data area, in addition to graphics, may include instructions for playing the game, and, in some cases, some means of identifying the game through electronic means such as through the use of a bar code and the like.

Scratch-off lottery games of the type mentioned above have conventionally employed a region in the non-game data area or game data area which has a preselected region for providing a readable portion of the ticket that can be used for authenticating and/or validating the ticket. This region is typically comprised of a conductive ink which can be read by a validation apparatus (e.g. a scanner) and the presence of a proper signal from the conductive ink indicates that the lottery ticket is an authentic ticket and/or a valid prize winning ticket.

However, the employment of this conductive ink region in the non-game data area of the lottery ticket has two disadvantages. First, the conductive ink region is visible to the user at the point of purchase. There therefore exists the possibility that the conductive ink region can be duplicated or transferred to another ticket in an effort to obtain a counterfeit prize. Another disadvantage of employing the conductive ink region in the non-game data area is that the conductive ink region has a tendency to detract from the graphic display provided in this portion of the lottery ticket. This is a problem for lottery ticket producers because the public has grown to demand a high quality level of graphics on a lottery ticket to spur purchases. In addition, the non-game data area often has the same overall appearance as the game data area. Since the game data area has a removable scratch-off material thereon, the purchasing public often expects the non-game data area to have a removable scratch-off material as well.

It would therefore be a advance in the art of producing scratch-off lottery tickets if a lottery ticket could be developed in which the conductive ink region used for authenticating and/or validating a lottery ticket can be hidden from view so that it cannot be readily duplicated by the lottery purchaser or mislead the purchaser as to its purpose. It would be a further advance in the art of producing scratch-off lottery tickets if the conductive ink region, while being hidden from view, can be readily detected by existing detection equipment employed currently in the lottery industry.

SUMMARY OF THE INVENTION

The present invention is generally directed to documents such as a lottery ticket which have an improved security system in which a portion of the lottery ticket is covered by a conductive ink which may be detectable by existing lottery ticket validation machines. The conductive ink portion is, in accordance with the present invention, hidden from the view of the player when the ticket is purchased. The particular conductive ink portion of the ticket may be read by the authentication/validation machine even when hidden from view to provide an improved security system.

In one aspect of the present invention there is provided a lottery ticket comprising:

(a) a substrate;

(b) a non-game data area printed on a first portion of the substrate; and (c) a game data area printed on a second portion of the substrate, said game data area comprising game data, at least one ink layer having a first portion thereof printed in a non-conductive ink and a second portion thereof printed in a conductive ink, and an opaque layer covering said game data and said at least one ink layer, said conductive ink being detectable by a lottery ticket authentication/validation apparatus.

Methods of preparing such lottery tickets also constitute a part of the present invention.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The present invention is generally directed to documents such as a lottery ticket which have a scratch-off layer preventing the game data area from being viewed until the scratch-off layer is removed. The game data area includes a layer of ink having a non-conductive ink region and a conductive ink region. The conductive ink region may be read by an authentication/validation apparatus which can read the conductive ink region which lies beneath one or more layers of the lottery ticket including the security layers and lily pad layers as well as the scratch-off layers. The conductive ink is read for authentication/validation purposes once the scratch-off layer has been removed. The present invention provides an improvement over existing lottery tickets wherein the conductive ink region is exposed in the non-game data area or game data area. As a result, the present lottery ticket provides improved security and provides less interference with the appearance of the elaborate graphics typically imprinted in the non-game data area of the lottery ticket or with the play of the game data area i.e. players wanting to scratch-off the conductive ink area.

Figure 1:
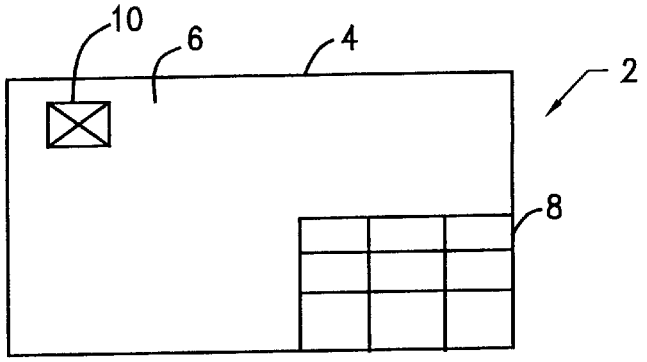
FIG. 1 (PRIOR ART)
FIG. 1 is a schematic view of a prior art scratch-off lottery ticket with a conductive ink area present in the non-game data area.

Referring to FIG. 1, there is shown a prior art lottery ticket 2 having a substrate 4 which may be non-foil material such as paper stock, recycled paper and the like.

The substrate 4 is divided into a non-game data area 6 and a game data area 8. The non-game data area 6 includes a series of layers (not shown) which provide a graphic design, typically corresponding to the theme of the lottery ticket. The non-game data area 6 may also provide instructions on how to play the game and/or advertising copy identifying the host of the game (e.g. a State Lottery).

The game data area 8 typically comprises several layers including, but not limited to, a layer of printed indicia which according to the rules of the lottery game, determines if a prize has been won. Above the printed indicia layer is a scratch-off layer which covers the printed indicia layer until the player removes the scratch-off layer to determine if a prize has been won.

As shown in FIG. 1, typical prior art lottery tickets have a region 10 printed on the non-game data area 6 in the form of a conductive ink. The conductive ink may be read by an authentication/validation apparatus of the type commonly employed in the lottery industry (e.g. a scanner), and such inks are well known in the art. The conductive ink region 10 is visible when the player purchases a lottery ticket. It is therefore vulnerable to removal by unscrupulous players who can alter or replace the conductive ink region 10.

In accordance with the present invention, a document such as a lottery ticket employs a conductive ink region used for validation and/or authentication. The conductive ink region is placed within the game data area beneath the scratch-off layer and typically also beneath one or more security layers and lily pad layers. The conductive ink region is therefore hidden from view even after the scratch-off layer is removed and does not interfere with the graphics of the lottery ticket which appear in the non-game data area or the game data area. In addition, the conductive ink area is less susceptible to tampering by those who wish to counterfeit lottery tickets.

Figure 2:
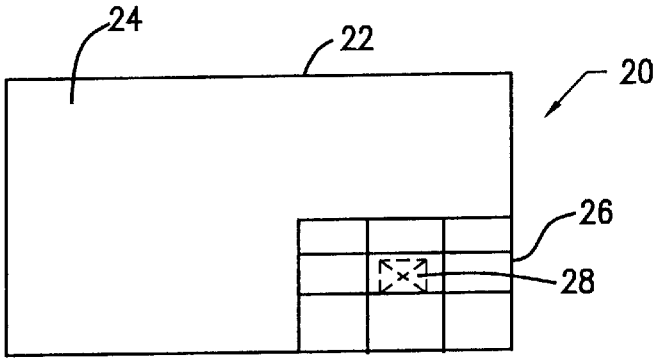
FIG. 2 is a schematic view of an embodiment of the lottery ticket in accordance with the present invention in which a conductive ink area is printed in the game data area and is hidden from view by an opaque scratch-off layer.

Referring to FIG. 2 a lottery ticket 20 in accordance with the present invention has a substrate 22 made from the same substrate materials discussed above in connection with the prior art lottery ticket of FIG. 1 (e.g. paper stock, recycled paper and the like). The lottery ticket 20 is divided into a non-game data area 24 and a game data area 26. The non-game data area may include the same type of graphics provided with the prior art ticket of FIG. 1. However, in accordance with the present invention, the non-game data area 24 no longer includes a conductive ink region (see numeral 10 of FIG. 1) that is used for validation and/or authentication purposes.

Instead, the present invention provides for the presence of a conductive ink region 28 in the game data area 26. As will be discussed in more detail below in connection with FIG. 3, the conductive ink region 28 is hidden from view and is detectable by conventional lottery authentication/validation devices.

Figure 3:
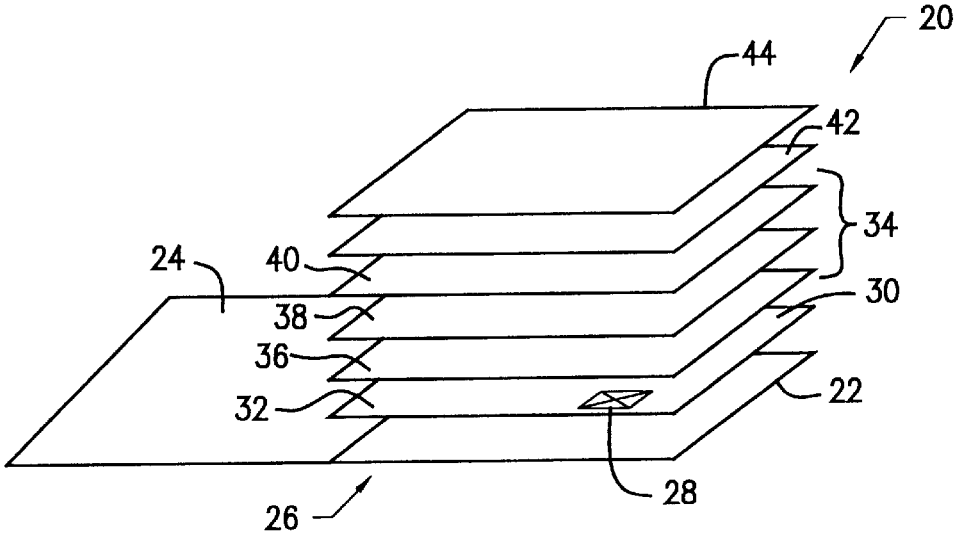
FIG. 3 is a schematic elevational view of several layers of the game data area of the lottery ticket shown in FIG. 2 and the position of the conductive ink area below the opaque scratch-off layer.

Further details of the construction of a lottery ticket in accordance with the present invention are shown in connection with FIG. 3. The various layers forming part of the game data area 26 are illustrated whereas the layers that may be employed in the non-game data area have been omitted for the sake of clarity.

Referring to FIG. 3, the present lottery ticket 20 has several layers generally comprising the game data area 26. Printed immediately above the substrate 22 is a layer 30 comprised of a conductive ink region 28 and a non-conductive ink region 32. Conductive inks and non-conductive inks for this purpose are known in the art. As more fully explained hereinafter, the conductive ink region 28 can be detected by available validation devices (e.g. a scanner) to determine the authenticity and/or validity of the lottery ticket. In a preferred form of the invention, both the non-conductive ink region 32 and the conductive ink region 28 have the same color (e.g. black) so as to make it more difficult to detect the position of the conductive ink region 28 which provides a means for authenticating and/or validating the lottery ticket.

Above the layer 30 are a series of layers that typically provide game data, scratch-off capability and security for the lottery ticket. By way of example and referring specifically to FIG. 3, there is provided a printed indicia region 34 which provides printed indicia to determine if a prize has been won. A typical composition of the printed indicia region 34 is one or more background layers (typically a white ink layer known in the lottery industry as a lily pad) 36 which has imprinted thereover additional colored layers represented by numeral 38 and a layer which provides the actual symbols or icons to determine if a prize has been won as represented by numeral 40. A protective or sealing layer 42 is provided over the printed indicia layer 40 to provide security for the lottery ticket by preventing interference with the prize symbols and an additional measure of protection against chemical or physical lifting of the prize symbols.

An opaque scratch-off layer which can include one or more layers of an opaque latex material is provided over the entire game area and is designated by numeral 44. Compositions for use as an opaque scratch-off layer are well known in the art.

As can be seen from FIG. 3, the opaque scratch-off layer 44 and one or more of the layers 36, 38 and protective layer 42 contribute to hiding the conductive ink region 28 from view.

Machines of the type customarily employed in state lotteries to authenticate and/or validate lottery tickets can detect a conductive ink region 28 as previously indicated in connection with the prior art ticket of FIG. 1. It has been determined that the same type of devices can detect the conductive region 28 employed for the lottery tickets of the present invention through the layers 36, 38 and 42 so that authentication and/or validation of the ticket after the scratch-off layer 44 has been removed can be made by the lottery sponsors.

What is claimed:

1. A lottery ticket comprising:

a) a substrate;

b) a non-game data area printed on the substrate;

c) a game data area printed on a second portion of the substrate and comprising game data, a layer having a first portion thereof printed in a non-conductive ink and a second portion thereof printed in a conductive ink, and an opaque scratch-off layer covering said game data and said layer.

2. A lottery ticket of claim 1 wherein the non-conductive ink and the conductive ink have the same color.

3. The lottery ticket of claim 1 further comprising at least one lily pad layer and at least one security layer between the game data and the opaque scratch-off layer, said conductive ink portion being detectable through said lily pad layer and said security layer.

4. A method of producing a lottery ticket comprising:

(a) printing non-game data on a first portion of a substrate;

(b) printing a conductive ink region on a second portion of the substrate different than the first portion of the substrate;

(c) printing game data over the conductive ink region; and (d) applying an opaque scratch-off layer over the game data.

5. The method of claim 4 further comprising applying at least one layer selected from a lily pad layer and a security layer between the conductive ink region and the scratch-off layer.

* * * * *